US007623081B2

(12) United States Patent
Saito et al.

(10) Patent No.: US 7,623,081 B2
(45) Date of Patent: Nov. 24, 2009

(54) WIRELESS UWB CONNECTION FOR ROTATING RF ANTENNA ARRAY

(75) Inventors: Masashi Saito, Newton, MA (US); Andreas F. Molisch, Arlington, MA (US); Jinyun Zhang, Cambridge, MA (US)

(73) Assignee: Mitsubishi Electric Research Laboratories, Inc., Cambridge, MA (US)

( * ) Notice: Subject to any disclaimer, the term of this patent is extended or adjusted under 35 U.S.C. 154(b) by 168 days.

(21) Appl. No.: 12/019,737

(22) Filed: Jan. 25, 2008

(65) Prior Publication Data

US 2009/0189820 A1 Jul. 30, 2009

(51) Int. Cl.
*H01Q 3/00* (2006.01)

(52) U.S. Cl. ..... 343/757; 343/758; 343/763

(58) Field of Classification Search ..... 343/757, 343/758, 759, 763, 765
See application file for complete search history.

(56) References Cited

U.S. PATENT DOCUMENTS

2008/0189747 A1 * 8/2008 DiFonzo et al. ..... 725/68
2008/0225375 A1 * 9/2008 Newberg et al. ..... 359/279
2008/0246676 A1 * 10/2008 Stoyanov et al. ..... 343/765
2008/0303714 A1 * 12/2008 Ezal et al. ..... 342/357.12

* cited by examiner

*Primary Examiner*—HoangAnh T Le
(74) *Attorney, Agent, or Firm*—Dirk Brinkman; Gene Vinokur

(57) ABSTRACT

A movable portion of an array of antenna elements receives RF signals. A movable ultra-wideband (UWB) transmitter is connected to each antenna element, via a RF to UWB converter. A fixed portion of the antenna array is separated from the movable portion by an air gap. The fixed portion includes one fixed UWB receiver for each movable UWB transmitter. An application system is connected to the fixed UWB receivers. The UWB signals from the movable transmitter are sent across the air gap to the fixed UWB receivers to be processed by the application system as the movable portion rotates.

12 Claims, 3 Drawing Sheets

100

WIRELESS UWB CONNECTION FOR ROTATING RF ANTENNA ARRAY

FIELD OF THE INVENTION

This invention relates generally to RF antenna arrays, and more particularly to connectors for moving RF antenna arrays.

BACKGROUND OF THE INVENTION

A radio frequency (RF) antenna array typically includes multiple RF antenna elements coupled to transmit and/or receive (transceive) directive RF signals. Usually the spatial relationship of the antenna elements contributes to the directivity of the antenna. The RF antenna array enables a transmitter and/or receiver (transceiver) to focus transmission and/or reception in a specific direction. This increases the signal-to-noise ratio and lowers interference to and from other RF signals.

Frequently, RF antenna arrays are arranged to rotate or oscillate. As an advantage, moving antennas have better directional characteristics, wider bandwidth signal utilization, and an omni-directional search within a specified time period.

However, there is a problem in connecting the antenna elements to the transceiver. Simple cable connections are always not possible, because the array and the transceiver are rotating with respect to each other. Thus, a simple mechanical connection is not possible. Other solutions that use "brushing" contacts are unreliable, and suffer from wear, tear and noise in the signals.

It is desired to connect a movable antenna array to a transceiver without using mechanical connections.

SUMMARY OF THE INVENTION

A movable portion of an array of RF antenna elements is configured to receive RF signals. A movable ultra-wideband (UWB) transmitter is connected to each RF antenna element, via a RF to UWB converter.

A fixed portion of the RF antenna array is separated from the movable portion by an air gap. The fixed portion includes one fixed UWB receiver for each movable UWB transmitter. An application system is connected to the fixed UWB receivers.

The UWB signals from the movable transmitter are sent across the air gap to the fixed UWB receivers to be processed by the application system as the movable portion rotates. It is understood that the receive and transmit signaling can be reversed.

DETAILED DESCRIPTION OF THE PREFERRED EMBODIMENTS

RF Antenna Array Structure

Figure 1:
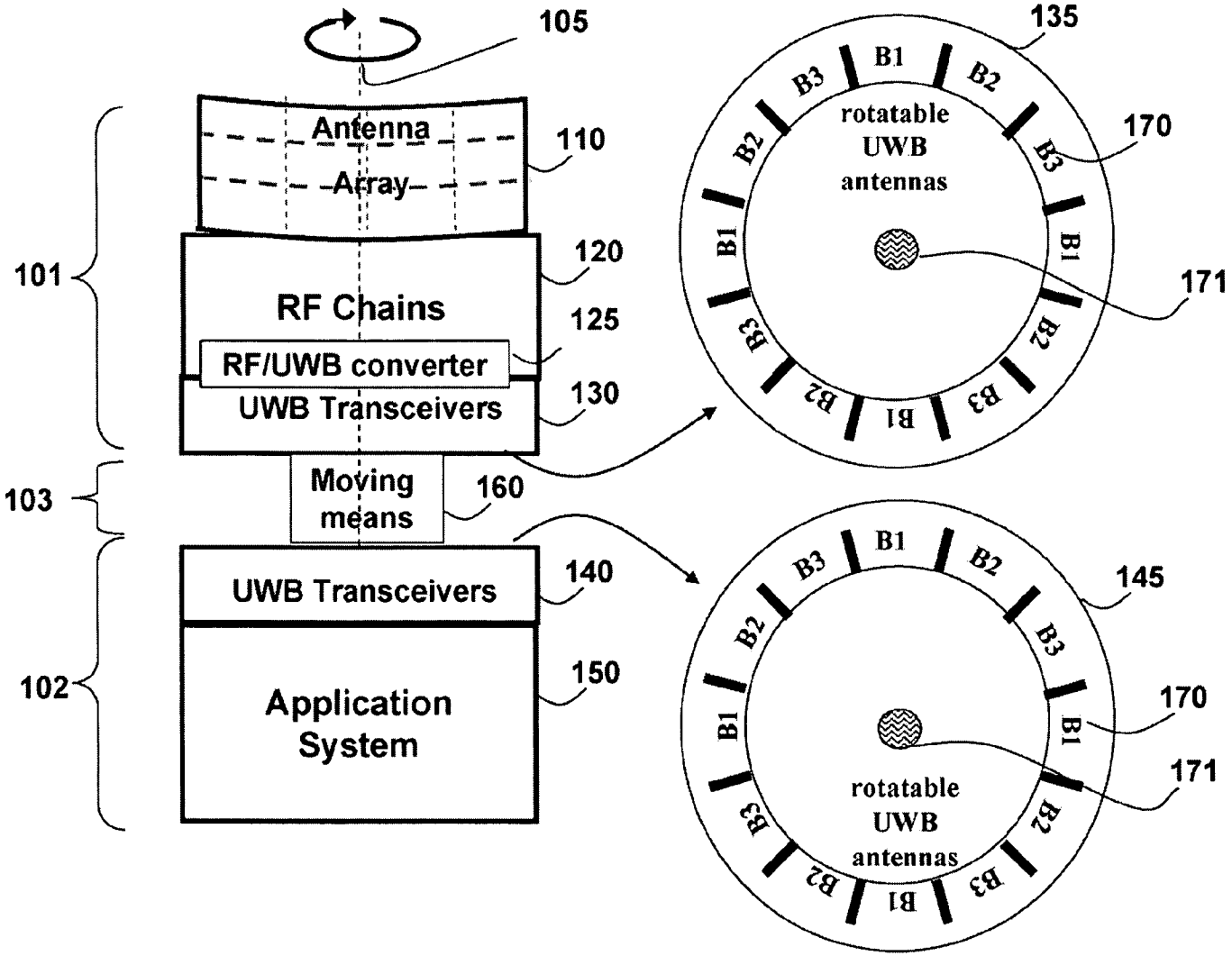
FIG. 1 is a block diagram of a movable RF array of antenna elements according to embodiments of our invention.

FIG. 1 shows schematically a movable array of RF antenna elements 100 according to embodiments of our invention. As used herein, the movable RF antenna array can rotate, oscillate, or undergo other linear or non-linear motion patterns.

The array includes a movable portion 101 and a fixed portion 102. The movable and fixed portions are separated by a small air gap 103, described in greater detail below. Conventional means 160 for moving the portion 101 can be arranged in the air gap 103, see U.S. Pat. No. 6,407,714 for an example rotator that moves antennas about an axis.

Movable Portion

The movable portion includes an array of (e.g., twelve) RF antenna elements 110 coupled to one or more RF transceiver chains 120. In one embodiment, each RF element is coupled to one RF chain. In another embodiment, the number of RF chains is less than the number of elements, and the RF chains are coupled to the elements as needed in a time-multiplexed manner.

A rotating ultra-wideband (UWB) transceiver 130 is coupled to each RF chains. The movable portion also includes means (RF/UWB) 125 for converting between RF and UWB signals.

As used herein, a transceiver can include a transmitter, or a receiver, or both a transmitter and a receiver. Similarly, to transceive means to transmit, or to receive, or to transmit and to receive. The receiving and transmitting can be accomplished by connected appropriate transmit and receive portions of RF and UWB chains to the antennas.

Fixed Portion

The fixed portion includes an application system 150 connected to fixed UWB transceivers 140.

In the above configuration the RF antenna elements 110 can receive (Rx) and transmit (Tx). It should be understood that if the RF antenna elements only receive, the RF chains are receivers connected to movable UWB transmitters, and the application system is connected to fixed UWB receivers. If the antennas only transmit, the arrangement of the transmitters and receivers is reversed.

Insets 135 and 145 show the arrangement of UWB transmit (Tx) and receive (Rx) antennas B1-B3 170. The UWB antennas 170 are spatially separated in a circular pattern on a bottom part of the movable portion and on a top part of the fixed portion. That is, the UWB antennas face each other across the air gap 103. The antennas 170 can either transmit or receive.

An additional UWB antenna 171 can be arranged at the center of the other UWB antennas. The antennas is also connected to a corresponding UWB transceiver. It is assumed that other configurations of the UWB antennas are also possible.

For example, the antennas can be placed in an arc for an oscillating antennas, in a linear pattern for linear motion. In general, the pattern of the antennas corresponds to the motion of the movable portion.

It should be noted, that the UWB transceiver can also use multi-input/multi-output (MIMO) techniques where each transceivers include a set of antennas to increase spatial diversity.

Antenna Array Operation

Ultra-Wideband Signaling

The RF antenna array operates at a high data rate. This data rate must be supported by the connection between the movable and fixed portion 101-102. Therefore, we use UWB signaling across the relatively small air gap 103. UWB refers to signaling with a bandwidth of at least 500 MHz. Pulsed based UWB can enable short-range gigabit-per-second communications. Another advantageous aspect of the UWB signaling for the purpose of our antenna array is that the pulses are very short, e.g., less than 20 cm for a 1.3 GHz bandwidth pulse with 16-QAM modulation. In generally, a data rate of the UWB signals can be inversely proportional to a size of the air gap.

Thus, conventional signal reflections do not overlap the original pulse, and thus conventional multipath fading of narrow band signals does not exist. In addition, the extremely large bandwidths inherent in UWB can achieve huge channel capacities without using higher order modulations that need a very high SNR to operate.

In order to achieve the desired high data rates, the signal from each RF antenna element 110 is converted 125 to a UWB signal for a corresponding one of the UWB antennas 170. To minimize interference between the UWB signals from different UWB antennas, adjacent fixed UWB antennas use different frequency bands as the movable antennas rotate. Thus, the movable antenna can always transmit or receive at the same subbands, and the movable antennas adjust their frequencies as they align with the movable antennas.

Figure 2:
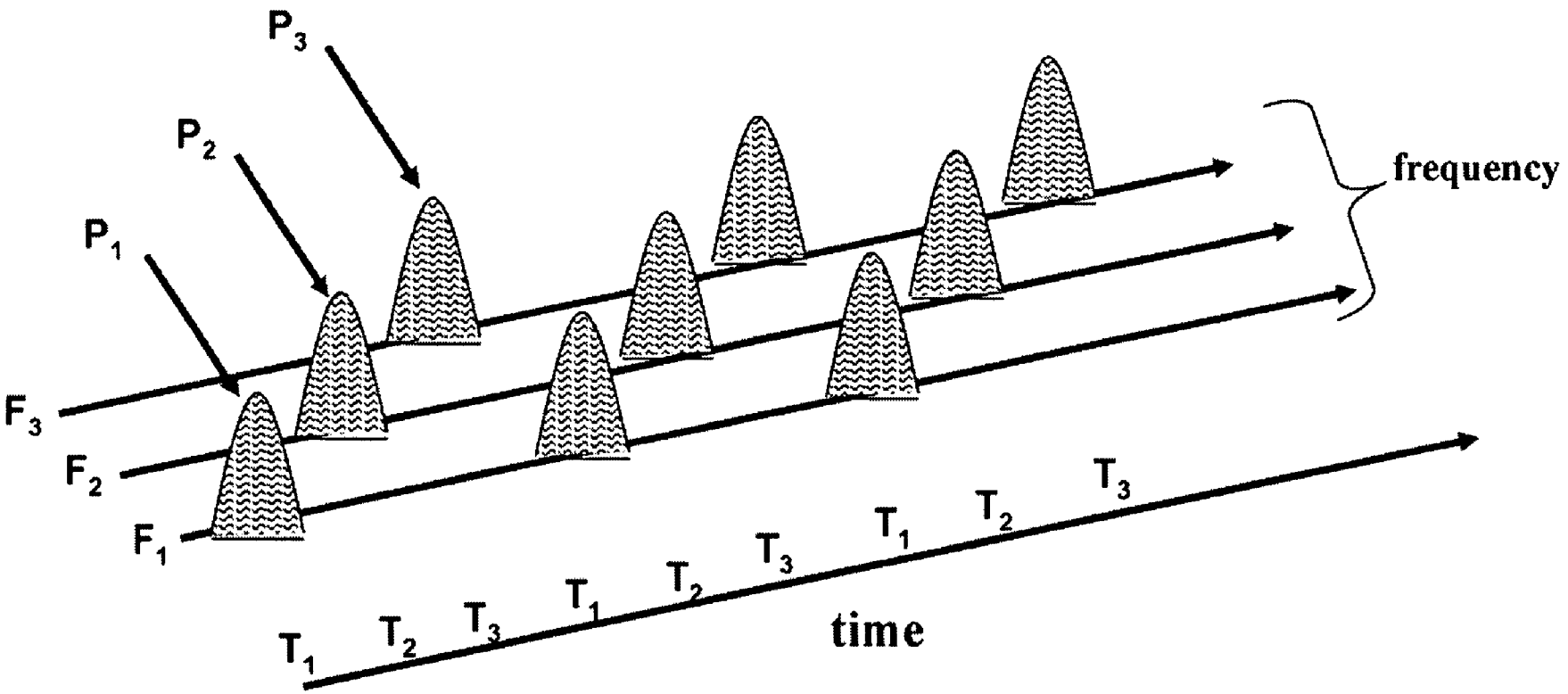
FIG. 2 is a timing diagram of three frequency subbands of UWB pulses according to an embodiment of the invention.

For example as shown in FIG. 2, we consider the case where there are twelve antenna elements 110, and the combined data rate should be 6 Gbit/s. Therefore, we partition the entire UWB frequency band into three subbands ($F_1$-$F_3$) for the UWB pulses ($P_1$-$P_3$) over time ($T_1$-$T_3$). Each of the three subband is at least 500 Hz. The antennas can transceive at all frequency subbands. The frequency subbands for the pulses for a particular antenna change as the movable portion rotates as shown in Fig. The labeling $B_1$-$B_3$ in FIG. 1 corresponds to grouping of the UWB antennas and UWB transceivers according to the three frequency subbands. In this way, at any time, any group of three spatially adjacent UWB antennas use different subbands.

As the movable portion rotates, the UWB antennas will not always be aligned, and each receive antenna can receive considerable contributions from at least two adjacent interfering transmit antennas operating on two different frequency bands. The interfering received UWB signals can be filtered.

Figure 3:
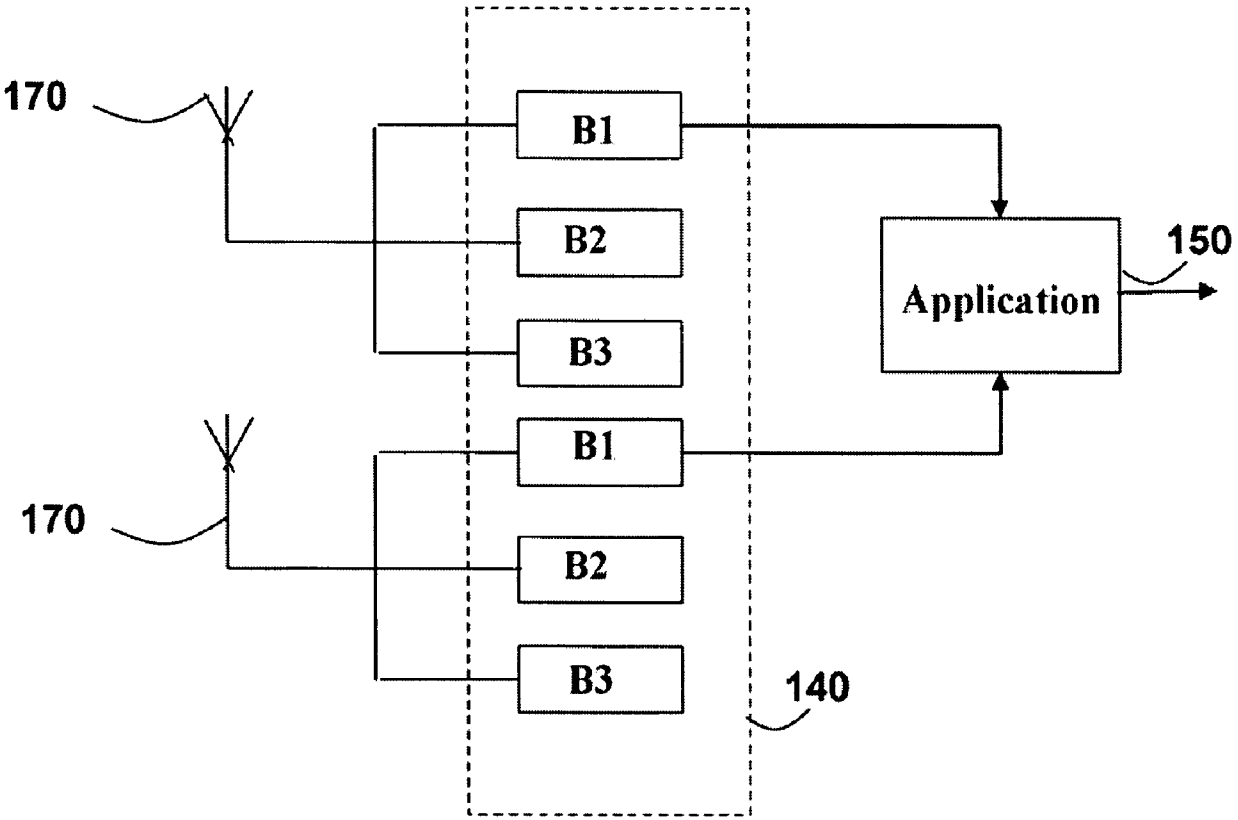
FIG. 3 is a block diagram of combining UWB signals from of adjacent UWB antennas according to an embodiment of the invention.

However, in a preferred embodiment as shown in FIG. 3, we combine the UWB signals from a specific transmit antenna with the received signal from adjacent receive antennas. It should be understood, that the same technique can be used for other movements, such as oscillation.

In particular embodiment of the invention we use UWB signals according to the ECMA 368 standard, also known as Multiband-OFDM or WiMedia. This standard foresees the subdivision of the available frequency range (3.1-4.8 GHz) into three frequency bands of 528 MHz bandwidth, with comparable data rates/s. The UWB transmitters can use frequency hopping, or remain on a fixed frequency band.

The central antennas 171, which in the circular arrangement, are always aligned can be used for control signals and calibration signals. Control signals can include signals for switching between transmit and receive modes for the antenna array. Control signals can also change the azimuth and elevation angles of the array elements 110.

Although the invention has been described by way of examples of preferred embodiments, it is to be understood that various other adaptations and modifications may be made within the spirit and scope of the invention. Therefore, it is the object of the appended claims to cover all such variations and modifications as come within the true spirit and scope of the invention.

We claim:

1. An apparatus, comprising:

a movable portion comprising:

an array of RF antenna elements configured to receive RF signals; and a movable ultra-wideband (UWB) transmitter connected to each RF antenna element via means for converting between the RF signals to UWB signals, each movable UWB transmitter including one UWB antenna;

a fixed portion, separated from the movable portion by an air gap, and further comprising:

one fixed UWB receiver for each movable UWB transmitter, each fixed UWB receiver including one UWB antenna; and an application system connected to the fixed UWB receiver, and in which tile movable UWB transmitters are configured to communicate the converted RF signals as the UWB signals across the air gap to be processed by the application system while the movable portion moves.

2. The apparatus of claim 1, in which a pattern of placement of the UWB antennas corresponds to a motion of the movable portion.

3. The apparatus of claim 1, in which the UWB antennas are arranged in a circular pattern and the movable portion rotates.

4. The apparatus of claim 1, in which the UWB antennas are arranged in an arc and the movable portion oscillates.

5. The apparatus of claim 3, in which an additional UWB antenna is arranged at a center of the circular patterns.

6. The apparatus of claim 1, in which the UWB antennas are configure to use MIMO techniques.

7. The apparatus of claim 1, in which the UWB transmitters and receivers share a single UWB frequency band, and in which the single UWB frequency band is partitioned into three subband, and any group of three spatially adjacent UWB antennas uses different subbands.

8. The apparatus of claim 7, in which a data rate of the UWB signals is inversely proportional to a size of the air gap.

9. The apparatus of claim 7, in the subbands used by the fixed UWB transceivers are adjusted to correspond to the subbands of the movable transceivers as the movable transceivers move.

10. The apparatus of claim 7, in which the UWB signals of adjacent UWB antennas are combined.

11. The apparatus of claim 5, in which the central antenna is used for control signals.

12. A method for operating a RF antenna array, comprising:

receiving RF signals by a movable array of antenna elements;

converting the RF signals received by each antenna element to an ultra-wideband (UWB) signal;

transmitting the UWB signals to fixed UWB receivers as the antenna elements move; and receiving the UWB signals by the fixed transceivers to be processed by an application system.

* * * * *